US006896602B2

(12) United States Patent
Oshita et al.

(10) Patent No.: US 6,896,602 B2
(45) Date of Patent: May 24, 2005

(54) WAFER HOLDING RING FOR CHEMICAL AND MECHANICAL POLISHER

(75) Inventors: Tetsuya Oshita, Tokyo (JP); Masami Aizawa, Tokyo (JP); Katsuyuki Sakamoto, Tokyo (JP)

(73) Assignee: Clariant Finance (BVI) Limited, Tortola (VG)

( * ) Notice: Subject to any disclaimer, the term of this patent is extended or adjusted under 35 U.S.C. 154(b) by 0 days.

(21) Appl. No.: 10/398,600

(22) PCT Filed: May 8, 2002

(86) PCT No.: PCT/JP02/07973

§ 371 (c)(1),
(2), (4) Date: Apr. 4, 2003

(87) PCT Pub. No.: WO03/015147

PCT Pub. Date: Feb. 20, 2003

(65) Prior Publication Data

US 2004/0023609 A1 Feb. 5, 2004

(51) Int. Cl.[7] ..... B24B 47/02
(52) U.S. Cl. ..... 451/398; 451/285
(58) Field of Search ..... 451/397, 398, 451/285, 286, 287, 288, 289

(56) References Cited

U.S. PATENT DOCUMENTS

| | | | | |
|---|---|---|---|---|
| 26,065 | A | 11/1859 | Wuterich et al. | |
| 3,313,783 | A | 4/1967 | Iwakura et al. | |
| 3,408,336 | A | 10/1968 | Benson | |
| 3,433,772 | A | 3/1969 | Chenevey et al. | |
| 3,509,108 | A | 4/1970 | Prince | |
| 3,518,234 | A | 6/1970 | Hara et al. | |
| 3,549,603 | A | 12/1970 | Chenevey | |
| 3,555,389 | A | 1/1971 | Opal | |
| 3,578,644 | A | 5/1971 | Trischler | |
| 3,708,439 | A | 1/1973 | Sayigh et al. | |
| 4,154,919 | A | 5/1979 | Sheratte | |
| 4,312,976 | A | 1/1982 | Choe | |
| 4,377,546 | A | 3/1983 | Helminiak et al. | |
| 4,549,388 | A | 10/1985 | Lancaster | |
| 5,704,494 | A | 1/1998 | Nishikiori et al. | |
| 5,932,688 | A | 8/1999 | Murata | |
| 6,468,136 | B1 * | 10/2002 | Lum et al. | 451/41 |
| 2002/0182867 | A1 * | 12/2002 | Kajiwara et al. | 438/692 |

FOREIGN PATENT DOCUMENTS

| | | |
|---|---|---|
| EP | 0 392 855 | 10/1990 |
| EP | 0 392 856 | 10/1990 |
| EP | 1 065 030 | 1/2001 |

OTHER PUBLICATIONS

English abstract for JP 7–147247, Jun. 6, 1995.
English abstract for JP 8–187657, Jul. 23, 1996.
English abstract for JP 2000–052241, Feb. 22, 2000.
English abstract for JP 2000–084837, Mar. 28, 2000.
Critchley, J.P., et al., "Heat–resistant polymers–technologically useful materials", Plenum press, New York, 1983, pp. 256–322.

* cited by examiner

*Primary Examiner*—Dung Van Nguyen
(74) *Attorney, Agent, or Firm*—Alan P. Kass

(57) ABSTRACT

Disclosed is a wafer-holding ring adapted for holding a wafer on a chemical mechanical polishing apparatus, which can prevent damage to a wafer, possesses excellent abrasion resistance, and can reduce replacement work and consequently can realize mass production of polished wafers. In the wafer-holding ring for a chemical mechanical polishing apparatus, the surface of the wafer-holding ring at least in its portion, which can come into contact with a wafer, is formed of a resin composition comprising not less than 30% by weight of polybenzimidazole.

9 Claims, 2 Drawing Sheets

[Fig1]
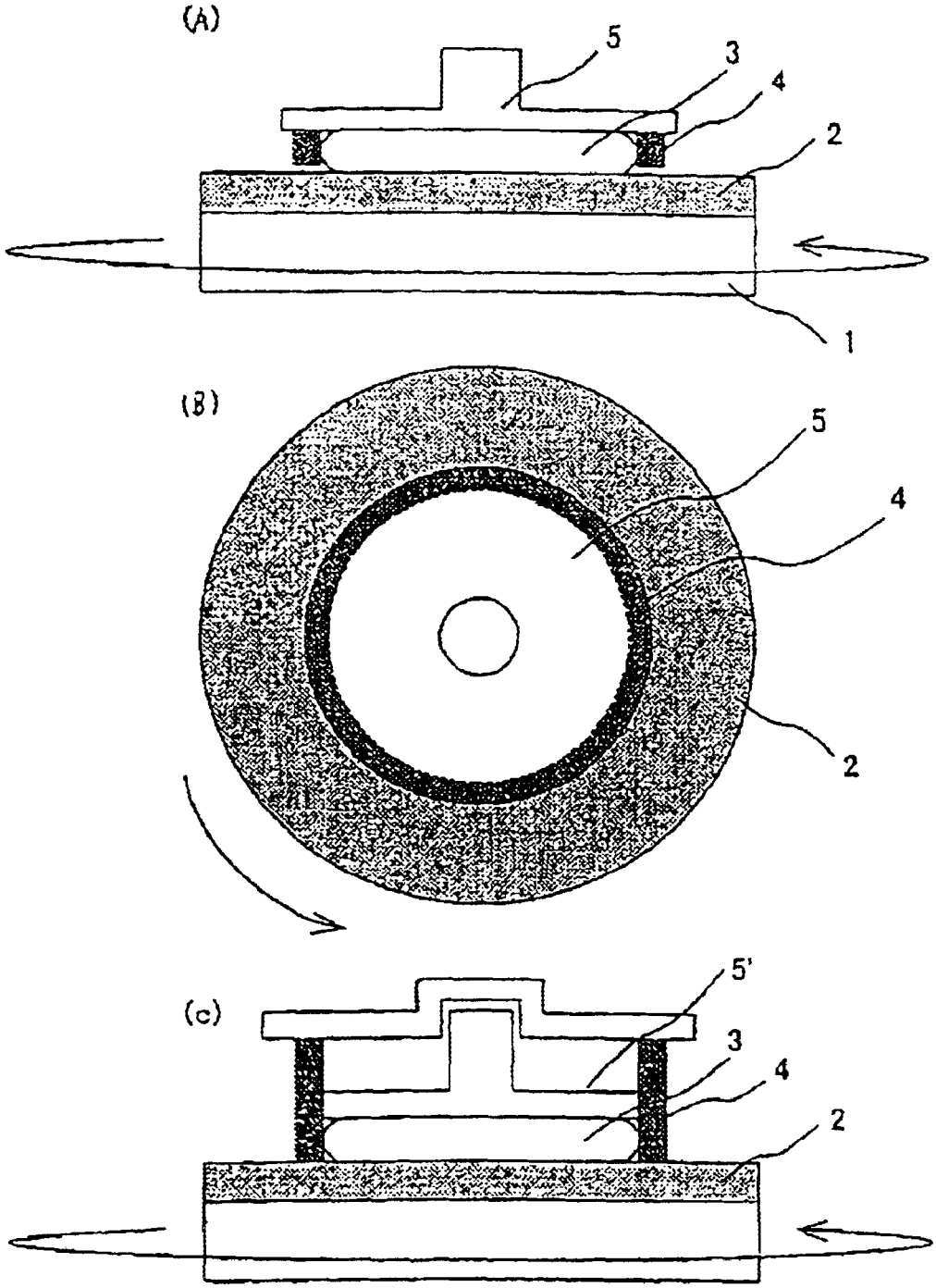

[Fig 2]
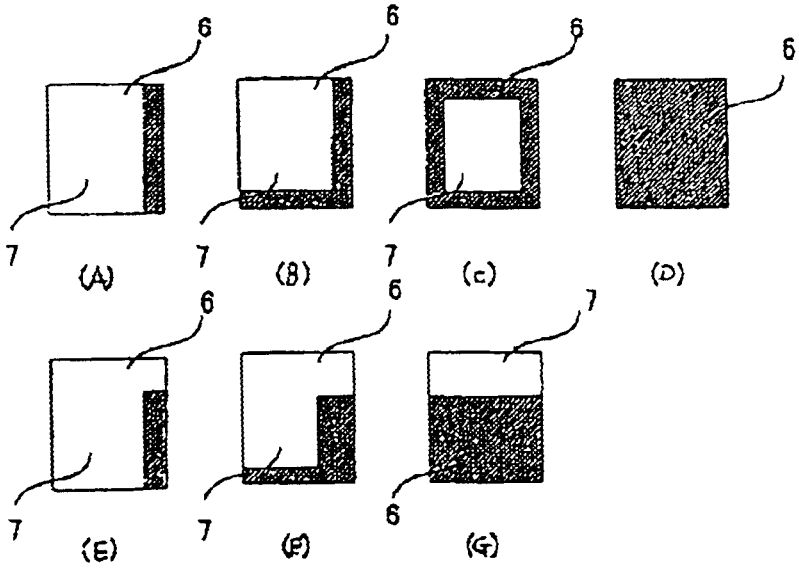

WAFER HOLDING RING FOR CHEMICAL AND MECHANICAL POLISHER

FIELD OF THE INVENTION

The present invention relates to a wafer-holding ring for a chemical mechanical polishing (hereinafter referred to as "CMP") apparatus.

BACKGROUND ART

In recent years, the production of LSIs has been shifted toward higher integration density, i.e., to 256 megabits and, further, to gigabits. The adoption of a laminate structure of a plurality of layers, such as electric wiring patterns and insulating layers, and finer design rules are necessary for the realization of higher integration density of LSIs. When the lamination and the formation of a finer pattern are simultaneously carried out, at the time of the lamination, the formation of a resist pattern on the lower layer having on its surface concaves and convexes adversely affects particularly exposure of a resist. Specifically, when the underlying layer as a resist coating face is not flat, for example, reflection notching of exposure light from the concaves and convexes on the surface of the underlying layer makes it difficult to form a resist image with predetermined resolution.

In order to solve this problem involved in the exposure of the resist, various methods for flatting the layer as the resist coating face have been developed and utilized. One of the methods for flatting is to use a CMP apparatus and has already been used in some fields. A design rule on the order of quarter microns or less has recently become adopted, and this has focused significant attention of CMP techniques.

The CMP apparatus is generally as shown in FIG. 1, wherein FIG. 1A is a cross-sectional view along the rotation center axis and FIG. 1B a top view. This apparatus comprises: a rotating base 1 having a flat surface; at least one polishing pad 2 which is provided on the surface of this base and is rotated together with the base; means (not shown) for feeding slurry to the polishing pad; a wafer-holding ring 4 (referred to also as "retainer ring" or "carrier ring") which is provided so as to face the polishing pad and surrounds the circumference of a semiconductor wafer 3 and holds the semiconductor wafer 3 on the surface of the polishing pad; and a carrier 5 which, together with the wafer-holding ring, holds the wafer. Vibration generation means for generating relative vibration between the polishing pad and the semiconductor wafer is optionally provided. The surface of the wafer 3 is polished by rotating the rotating base 1 while feeding slurry to the area of contact between the wafer 3 and the polishing pad 2.

FIG. 1C is a cross-sectional view of another example of the CMP apparatus. In this apparatus, the wafer 3 is pressed against the polishing pad by a member 5' provided on the inner side of the wafer-holding ring 4 and is polished. Instead of the member for pressing the wafer against the polishing pad, for example, compressed air may be used to press the wafer against the polishing pad.

The slurry used for polishing generally comprises an abrasive and an alkaline or acidic liquid for chemically reacting and dissolving a metal layer or an oxide layer. There are a wide variety of polishing objects, the surface of which can be flattened by this CMP method, such as oxide layers, polysilicon layers, and metal layers. Therefore, a best suited abrasive or slurry composition is selected according to the object to be polished. Representative abrasives usable in this slurry for CMP include colloidal silica, fumed silica, precipitated alumina, and fumed alumina. In polishing an oxide layer, in many cases, colloidal silica or fumed silica is used. When colloidal silica is used as the abrasive, the colloidal silica is generally produced from sodium silicate ($Na_2SiO_3$).

The wafer-holding ring is provided for accurately holding the semiconductor wafer at the time of polishing and changing and regulating the polished state of the surface of the semiconductor wafer. At the time of polishing of the semiconductor wafer, the wafer-holding ring comes also into contact with the polishing pad and thus is polished and abraded. Therefore, when the abrasion loss has reached a given value, the wafer-holding ring should be replaced.

Therefore, when a relatively soft resin is used as a material for the wafer-holding ring, the wafer-holding ring is rapidly abraded and, in this case, the wafer-holding ring should be frequently replaced.

In order to reduce the abrasion loss, a hard material is sometimes used as the soft resin. Conventional hard materials for wafer-holding ring are alumina and metals such as titanium. The use of metals, however, has a fear of the wafer being contaminated with the metals. Further, in some cases, the outer edge of the wafer collides with the internal circumference of the wafer-holding ring during polishing, and, consequently, the wafer is damaged.

Japanese Patent Laid-Open No. 187657/1996 discloses a wafer-holding ceramic ring. In this wafer-holding ring, although the abrasion resistance is improved, as with the wafer-holding metallic ring, the wafer is sometimes damaged.

Japanese Patent Laid-Open No. 52241/2000 discloses a method wherein the inner circumference portion of a wafer-holding ring formed of an abrasion-resistant material, that is, the wafer-holding ring in its portion, which comes into contact with the wafer, is formed of a soft material. Since this wafer-holding ring is on the assumption that the soft material used in the inner circumference portion is abraded, the thickness should be larger than that of the conventional wafer-holding ring. This requires a special design also in apparatuses utilizing this wafer-holding ring.

SUMMARY OF THE INVENTION

According to the present invention, there is provided a wafer-holding ring for a chemical mechanical polishing apparatus, adapted for holding a wafer on the chemical mechanical polishing apparatus, wherein the surface of said wafer-holding ring at least in its portion, which can come into contact with a wafer, is formed of a resin composition comprising not less than 30% by weight of polybenzimidazole.

This wafer-holding ring for a chemical mechanical polishing apparatus can prevent damage to a wafer, possess excellent abrasion resistance, oxidative degradation resistance, and hydrolysis resistance, and can reduce replacement work and consequently can realize mass production of polished wafers.

BRIEF DESCRIPTION OF THE DRAWINGS

FIG. 1 is a typical diagram of a chemical mechanical polishing apparatus, wherein FIG. 1A is an elevational cross-sectional view and FIG. 1B a top view thereof and FIG. 1C is a cross-sectional view of another example for the chemical mechanical polishing apparatus;

FIG. 2 a typical diagram of a sectional structure of a wafer-holding ring according to the present invention.

DETAILED DESCRIPTION OF THE INVENTION

Polybenzimidazoles usable in materials for the article according to the present invention are heterocyclic polymers possessing excellent heat stability, oxidative degradation resistance, hydrolysis resistance and other properties and can be produced, for example, by condensation polymerization of one or more aromatic tetramines and one or more aromatic, aliphatic, or heterocyclic dicarboxylic acids, esters thereof, or anhydrides thereof in a one-stage or two-stage process. The above production process is described in various U.S. patents, for example, U.S. Reissue Pat. No. 26,065 and U.S. Pat. Nos. 3,313,783, 3,509,108, 3,518,234, 3,555,389, 3,433,772, 3,408,336, 3,578,644, 3,549,603, 3,708,439, 4,154,919, 4,312,976, 4,377,546, and 4,549,388. Other production processes of polybenzimidazoles are explained in J. P. Critchley, G. J. Knight and W. W. Wright, "Heat-Resistant Polymers—Technologically Useful Materials," Plenum press, New York (1983), pp. 256–322.

A condensation reaction of the aromatic tetraamine (I) with the aromatic, aliphatic, or heterocyclic dicarboxylic acid or ester or anhydride thereof (II) to produce a polybenzimidazole is represented, for example, by the following formula.

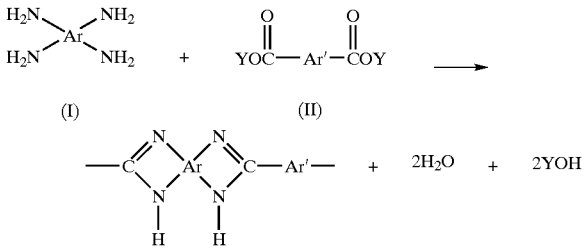

wherein Ar represents a tetravalent aromatic group and, in the four amino groups, each two amino groups constitute one pair and the two pairs are bonded to respective o-positions of the aromatic nucleus;

Ar' represents a divalent aromatic, alkylene, or heterocyclic group; and

Y represents a hydrogen atom, an aryl group, preferably a phenyl group, or an alkyl group, and not more than 95% of Y is hydrogen or a phenyl group.

A mixture of two or more aromatic tetraamines (I) with two or more dicarboxylic acid compounds (II) may also be used.

Specific examples of aromatic tetraamines (I) usable herein include compounds represented by the following formulae.

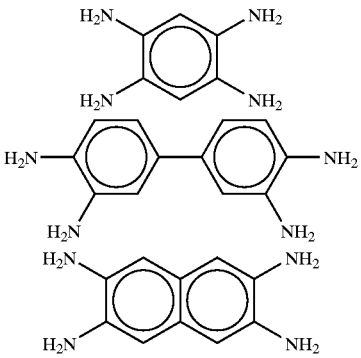

-continued

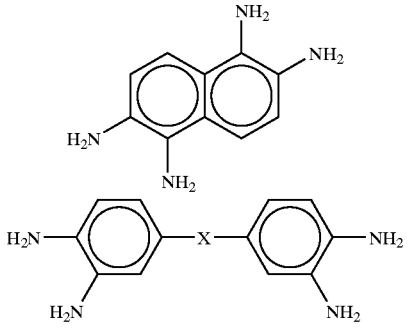

wherein X represents —O—, —S—, —$SO_2$—, or a lower alkylene group such as —$CH_2$—, —$(CH_2)_2$—, or —$C(CH_3)_2$—.

A preferred aromatic tetraamine is 3,3',4,4'-tetraaminobiphenyl.

The dicarboxylic acid component may be (i) a mixture of a free acid with at least one diester and/or a monoester, (ii) a mixture of diesters and/or monoesters, or (iii) a single dialkyl ester, monoester, or a mixed aryl alkyl or alkyl/alkyl ester. The dicarboxylic acid component may consist entirely of a free acid or a diphenyl ester. When Y represents an alkyl group, the alkyl group preferably has 1 to 5 carbon atoms and is most preferably a methyl group. When Y represents an aryl group, the aryl group may be substituted by any inert monovalent group such as alkyl or alkoxy having 1 to 5 carbon atoms, or may be an unsubstituted aromatic, alkylene, or heterocyclic group. The aromatic group may be any monovalent aromatic group formed by saturating all the valences except for one valence of the aromatic group with hydrogen. Specific examples of the aryl group include a phenyl group, a naphthyl group, three types of phenyl groups, and three types of tolyl groups. The aryl group is preferably a phenyl group.

Suitable dicarboxylic acids usable in the above production process include (i) aromatic dicarboxylic acids, (ii) aliphatic dicarboxylic acids, preferably aliphatic dicarboxylic acids having 4 to 8 carbon atoms, and (iii) heterocyclic dicarboxylic acids wherein a carboxyl group is a substituent on carbon atoms in cyclic compounds such as pyridine, pyrazine, furan, quinoline, thiophene, and pyran.

Dicarboxylic acids usable as the free acid or esters include, for example, the following aromatic dicarboxylic acids.

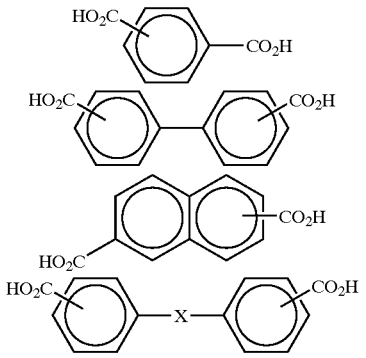

-continued

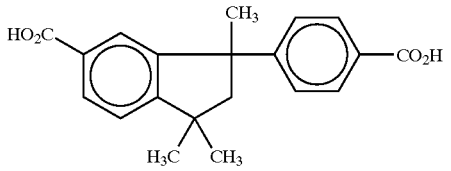

wherein X represents as defined above in connection with the aromatic tetraamine.

Specific examples of dicarboxylic acid compounds include isophthalic acid, terephthalic acid, 4,4'-biphenyldicarboxylic acid, 1,4-naphthalenedicarboxylic acid, diphenic acid (2,2'-biphenyldicarboxylic acid), phenylindandicarboxylic acid, 1,6-napthalenedicarboxylic acid, 2,6-naphthalenedicarboxylic acid, 4,4'-diphenyl ether dicarboxylic acid, and 4,4'-diphenyl thioether dicarboxylic acid. Among them, isophthalic acid is the most preferred dicarboxylic acid in the production of polybenzimidazole used as the free acid or ester in the present invention.

The dicarboxylic acid component may be used in an amount of about one mol in terms of the whole dicarboxylic acid component based on one mol of the aromatic tetraamine. However, the optimal ratio of reactants in a specific polymerization system can be easily determined by a person having ordinary skill in the art.

Specific examples of polybenzimidazoles, which can be prepared by the above methods, include:

poly-2,2'-(m-phenylene)-5,5'-bibenzimidazole;

poly-2,2'-(biphenylene-2",2")-5,5'-bibenzimidazole;

poly-2,2'-(biphenylene-4",4")-5,5'-bibenzimidazole;

poly-2,2'-(1",1",3"-trimethylindanylene)-3",5"-p-phenylene-5,5'-bibenzimidazole;

2,2'-(m-phenylene)-5,5'-bibenzimidazole/2,2'-(1",1",3"-trimethylindanylene)-5",3"-(p-phenylene)-5,5'-bibenzimidazole copolymer;

2,2"-(m-phenylene)-5,5"-bibenzimidazole-2",2"-5,5'-bibenzimidazole copolymer;

poly-2,2'-(furylene-2",5")-5,5'-bibenzimidazole;

poly-2,2'-(naphthalene-1",6")-5,5'-bibenzimidazole;

poly-2,2'-(naphthalene-2",6")-5,5'-bibenzimidazole;

poly-2,2'-amylene-5,5'-bibenzimidazole;

poly-2,2'-octamethylene-5,5'-bibenzimidazole;

poly-2,2'-(m-phenylene)-diimidazobenzene;

poly-2,2'-cyclohexenyl-5,5'-bibenzimidazole;

poly-2,2'-(m-phenylene)-5,5'-di(benzimidazole)-ether;

poly-2,2'-(m-phenylene)-5,5'-di(benzimidazole)-sulfide;

poly-2,2'-(m-phenylene)-5,5'-di(benzimidazole)-sulfone;

poly-2,2'-(m-phenylene)-5,5'-di(benzimidazole)-methane;

poly-2,2"-(m-phenylene)-5,5"-di(benzimidazole)-propane-2,2; and poly-ethylene-1,2-2,2"-(m-phenylene)-5,5"-di-(benzimidazole)ethylene-1,2 (in this case, the double bond in the ethylene group is left in the final polymer).

Among them, poly-2,2'-(m-phenylene)-5,5'-bibenzimidazoles is preferred as the polymer.

Polybenzimidazoles suitable for use in the wafer-holding ring according to the present invention can be specified by intrinsic viscosity. The intrinsic viscosity of polybenzimidazoles suitable in the present invention is 0.2 to 2.0, preferably 0.6 to 1.1.

In general, polybenzimidazoles have good chemical resistance, abrasion resistance, and high compression strength, and these properties are maintained even at high temperatures. In general, the limit of stable working properties derived from this nature limits applications of molded products of polybenzimidazoles. The incorporation of polyarylene ketones is possible for facilitating the working. Polyarylene ketones have good chemical resistance, compression strength, and mechanical properties although these properties are generally not superior to those of polybenzimidazoles. Further, polyarylene ketones are available more inexpensively than polybenzimidazoles. Therefore, the use of polyarylene ketones as a component of the resin composition can lower the cost. Preferably, however, when a polyarylene ketone is mixed with the polybenzimidazole, the polyarylene ketone is used in such an amount that does not sacrifice the above properties of polybenzimidazole.

Polyarylene ketones usable in the present invention are, for example, those represented by formula (III)

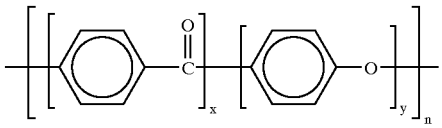

wherein x, y, and n are each an integer.

Typical polyarylene ketones are those represented by formula (III) wherein x is 1 or 2 and y is 1 or 2. Specific examples thereof include polyether ketone (V) wherein x is 1 and y is 1, polyether ether ketone (VI) wherein x is 1 and y is 2, polyether ether ketone ketone (VII) wherein x is 2 and y is 2, and polyether ketone ketone wherein x is 2 and y is 1. Among them, polyether ether ketone (PEEK) is a crystalline thermoplastic resin having properties similar to polyether ketones.

(IV)

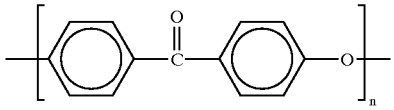

(V)

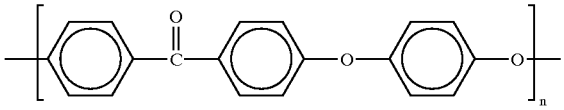

(VI)

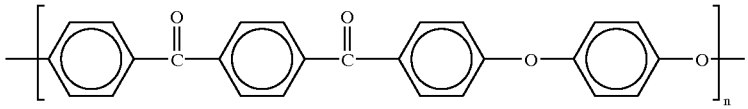

-continued (VII)

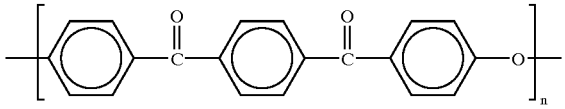

Polyarylene ketones useful for carrying out the present invention are polyether ketone or polyether ether ketone.

The resin composition used in the wafer-holding ring according to the present invention contains not less than 30% by weight, preferably not less than 50% by weight, of polybenzimidazole. The incorporation of polyarylene ketone is possible for improving the working properties. In this case, the polyarylene ketone may be used in such an amount that does not sacrifice the properties of polybenzimidazole. The amount of polyarylene ketone used, however, is preferably not more than 70% by weight, more preferably not more than 50% by weight.

The resin composition used in the wafer-holding ring according to the present invention may further contain other resin. Other resins usable herein include, for example, polyimide, polyamideimide, polyvinyl chloride, polyacetal, polyphenylene sulfide, polyethylene terephthalate, polyether sulfone, polysulfone, polyphenylene oxide, polyallylate, and epoxy glass. These resin materials should be used in such an amount that does not sacrifice the effect of the present invention.

The resin composition used in the wafer-holding ring according to the present invention may contain a filler for improving abrasion resistance and strength. The filler used in the present invention is not particularly limited, for example, so far as the above object can be attained. Preferred fillers include glass fibers, carbon fibers, graphite, boron nitride, carbon black, titanium oxide, and silicon oxide. In this case, the proportion of the filler incorporated is preferably not more than 40% by weight, more preferably not more than 30% by weight.

In the resin composition, the content of impurity metals is preferably low from the viewpoint of avoiding the contamination of wafers in the CMP process. Here the term "impurity metals" refers to metals that are present in wafers and deteriorate the properties of the wafers, although the type of metals varies depending upon wafers to be polished. The impurity metals include the above metals in any of ion, salt, and simple forms. Such impurity metals include iron, copper, chromium, nickel, sodium, potassium, calcium, magnesium, and lithium. The content of impurity metals in the resin composition used in the wafer-holding ring according to the present invention is preferably not more than 100 ppm, more preferably not more than 10 ppm.

In order to lower the content of impurity metals of the resin composition, impurity metals may be removed from each component of the resin composition, or alternatively may be removed from the whole resin composition. Impurity metals may be removed from polybenzimidazole as a main component of the resin composition used in the present invention by any method without particular limitation, and examples of methods usable for this include: a method wherein impurity metals present in the form of fine powder are separated by filtration; a method wherein impurity metals are removed from polybenzimidazole in a powder form by utilizing static electricity or magnetism; a method wherein a solution or dispersion of polybenzimidazole is treated with a cation exchange resin; a method wherein impurity metals are separated using a metal chelating agent; and a method wherein impurity metals are converted by an acid to salts that are soluble in water or lower alcohols which are poor solvents of polybenzimidazole, followed by the separation of the salts. These methods are also described in Japanese Patent Laid-Open No. 208699/1997.

When the resin composition used in the present invention contains a resin component other than polybenzimidazole, impurity metals may be removed from the resin component or from the polybenzimidazole-containing resin composition by a method selected from the above methods for removing impurity metals from polybenzimidazole.

The polybenzimidazole used in the wafer-holding ring according to the present invention is preferably poly-2,2'-(m-phenylene)-5,5'-bibenzimidazole represented by formula (VIII)

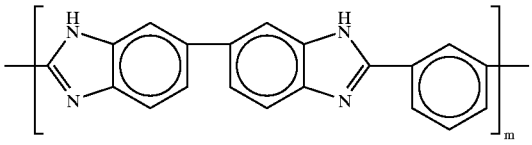

wherein m represents the degree of polymerization.

When the wafer-holding ring according to the present invention contains polyarylene ketone, the polyarylene ketone is preferably polyether ether ketone represented by formula (V).

The polybenzimidazole resin composition used in the present invention possesses excellent heat resistance, chemical resistance, radiation resistance and other properties and, in addition, excellent abrasion resistance and, thus, is very suitable as a material for a wafer-holding ring for a CMP apparatus, which comes into contact with a polishing pad.

In the wafer-holding ring according to the present invention, the surface of the wafer-holding ring at least in its portion, which can come into contact with a wafer, is formed of a resin composition comprising not less than 30% by weight of polybenzimidazole. Specific examples of the structure of this wafer-holding ring include: one wherein a surface layer formed of the above resin composition is provided on a part of the surface of a suitable core material; and one wherein the whole wafer-holding ring is formed of the above resin composition.

When a surface layer formed of the resin composition is provided on the surface of a core material, the surface layer is formed at least on a portion which probably comes into contact with a wafer. When the thickness of the wafer-holding ring is equal to or larger than the thickness of the wafer, a polishing pad sometimes comes into contact with the wafer-holding ring. In this case, preferably, the surface layer formed of the resin composition is also provided on the surface of the wafer holding ring in its portion which can come into contact with the polishing pad.

FIG. 2 is a typical diagram of a sectional structure of the wafer-holding ring. In FIG. 2 (sectional view), the right side is the inner side of the wafer-holding ring, that is, is a face which can come into contact with a wafer, and the upper side is a face of the side which is fixed to a carrier.

FIG. 2A is a typical diagram of a sectional structure of a wafer-holding ring wherein a surface layer 6 formed of the resin composition has been formed on a core material 7 only in its face which can come into contact with a wafer, FIG. 2B is a typical diagram of a sectional structure of a wafer-holding ring wherein a surface layer 6 formed of the resin composition has been formed on a core material 7 in its face, which can come into contact with a wafer, and in its face which can come into contact with a polishing pad, FIG. 2C is a typical diagram of a sectional structure of a wafer-holding ring wherein the whole surface of a core material 7 has been covered with a surface layer 6 formed of the resin composition, and FIG. 2D is a typical diagram of a sectional structure of a wafer-holding ring the whole of which is formed of the resin composition 6.

Further, in the CMP apparatus shown in FIG. 1C, the wafer does not come into contact with the whole inner side face of the wafer-holding ring. In this case, what is required is to cover only a portion, close to the polishing pad on the inner side of the wafer-holding ring, with the resin composition. FIGS. 2E to 2G are sectional views of such wafer-holding rings.

When the wafer-holding ring comprises a core material and a surface resin layer provided on the surface of the core material, the core material may be formed of a hard material or soft material commonly used in the prior art. Specific examples of materials usable herein include: resin materials such as polyarylene ketone, polyimide, polyamideimide, polyvinyl chloride, polyacetal, polyphenylene sulfide, polyether ether ketone, polyethylene terephthalate, polyether sulfone, polysulfone, polyphenylene oxide, polyallylate, and epoxy glass; metals such as alumina and titanium; and ceramics. The above material is molded into a core material by a suitable method, and a surface layer formed of the resin composition is then formed on the surface of the core material. The surface layer may be formed only on a face, which comes into contact with a wafer, and on a face, which comes into contact with a polishing pad, or alternatively may be formed on the whole surface of the core material.

The surface resin layer may be formed by any method without particular limitation, for example, by dissolving a polybenzimidazole resin composition in a solvent to prepare a solution, coating the solution onto the surface of a wafer-holding ring, and then heating the coating. When a filler insoluble in the solvent is added to the resin composition, preferably, the filler, together with a dispersing agent, is incorporated.

The thickness of the surface layer is preferably not less than 50 $\mu$m from the viewpoint of satisfactory abrasion resistance, oxidative degradation resistance, and hydrolysis resistance of the wafer-holding ring. The thickness of the surface layer is more preferably not less than 100 $\mu$m.

When the whole wafer-holding ring is formed of the above resin composition, the wafer-holding ring may be formed, for example, by a method wherein a powder of the polybenzimidazole resin composition is sinter molded into a desired shape, or by a method wherein the polybenzimidazole resin composition is pelletized to prepare pellets which are then injection molded into a desired shape. Molding methods for the polybenzimidazole mixture are disclosed, for example, in Japanese Patent Laid-Open No. 41150/1991 and Japanese Patent Laid-Open No. 296834/1990 and may be used in the present invention. When the wafer-holding ring is formed by injection molding, the incorporation of polyarylene ketone is preferred from the viewpoint of facilitating the injection molding.

EXAMPLE

The following examples further illustrate the present invention.

Example

Materials for wafer-holding ring for CMP apparatuses were evaluated for abrasion resistance.

Columnar materials having a size of 11.3 mmØ×10 mm formed of the following materials a to h were provided as specimens. A projected portion having a thickness of 500 to 800 $\mu$m was provided on one plane of each of the columnar materials. The projected portion was brought into contact with a counter material immersed in a slurry and was rotated while applying a load to the specimen to measure the abrasion loss. The abrasion loss was evaluated in terms of the degree of a reduction in height of the projected portion ($\mu$m) and the degree of a reduction in central sectional area ($\mu m^2$) of the projected portion. Further, the sectional form after the abrasion was inspected.

Testing conditions were as follows.

Contact pressure: 300 g/cm$^2$

Peripheral velocity: 0.9 m/sec

Abrasion time: 8 hr

Slurry used: Acidic slurry, W 2000, manufactured by CABOT Corporation Alkaline slurry, SS-25, manufactured by CABOT Corporation Counter material: IC 1000/SUBA 400, manufactured by RODEL Inc.

Evaluation material:

a. Polybenzimidazole (CELAZOLE U-60, manufactured by Clariant Japan K.K.)

b. 50% by weight of polybenzimidazole+50% by weight of polyether ether ketone (CELAZOLE TU-60, manufactured by Clariant Japan K.K.)

c. Polyimide (Vespel SP-1, manufactured by Du Pont Ltd.)

d. Polyphenyl sulfate (TECHTRON PPS, manufactured by Nippon Polypenco Limited)

e. Polyether ether ketone (PEEK NATURAL, manufactured by VICTOREX)

f. Polycarbonate (polycarbonate, manufactured by TAKIRON Co., LTD.)

g. Polyoxymethylene (Duracon, manufactured by Nippon Polypenco Limited)

h. Alumina

Here polybenzimidazoles a. and b. are represented by formula (VIII).

The results were as follows.

TABLE 1

| Material of specimen | Reduction in height, $\mu$m | | Reduction in sectional area, $\mu m^2$ | | Sectional form |
|---|---|---|---|---|---|
| | SS 25 | W 2000 | SS 25 | W 2000 | |
| a | 42 | 117 | 109333 | 193939 | A |
| b | 6 | 69 | 223000 | 295000 | A–B |
| c | 127 | 116 | 322344 | 477247 | B |
| d | 679 | 648 | 1827636 | 1738210 | C |
| e | 57 | 64 | 1122440 | 1407161 | B |
| f | 767 | 684 | 2078273 | 1977000 | C |
| g | 637 | 637 | 1556363 | 1335400 | C |
| h | 0 | 27 | 69000 | 81000 | A |

Here the sectional form after the abrasion was evaluated according to the following criteria.

A: The edge portion of the projected portion was almost maintained, or otherwise the edge portion was slightly rounded.

B: The edge portion of the projected portion and the internal circumference thereof were likely to be abraded.

C: The edge portion of the projected portion were significantly abraded and no edge portion was left.

The above results show that the abrasion resistance of polybenzimidazole-containing resin compositions is superior to that of resin materials which have hitherto been used as materials for wafer-holding ring. The abrasion resistance is next to that of alumina. Further, since the materials are resin compositions, there is no fear of wafers being contaminated with metals and, in addition, the outer edge of wafers is not damaged. The results further show that, also for the sectional form after abrasion, the wafer-holding ring according to the present invention undergoes no significant change in shape by abrasion. When the wafer-holding ring according to the present invention is used for CMP apparatuses, these properties are useful for reducing the frequency of replacement of the wafer-holding ring required as a result of a change in shape.

What is claimed is:

1. A wafer-holding ring for a chemical mechanical polishing apparatus, adapted for holding a wafer on the chemical mechanical polishing apparatus, wherein the surface of said wafer-holding ring at least in its portion, which can come into contact with a wafer, is formed of a resin composition comprising not less than 30% by weight of polybenzimidazole and not more than 70% by weight of polyarylene ketone.

2. The wafer-holding ring for a chemical mechanical polishing apparatus according to claim 1, wherein the resin composition further comprises not more than 40% by weight of a filler.

3. The wafer-holding ring for a chemical mechanical polishing apparatus according to claim 2, wherein the filler is a glass fiber, a carbon fiber, graphite, boron nitride, carbon black, titanium oxide, or silicon oxide.

4. The wafer-holding ring for a chemical mechanical polishing apparatus according to claim 3, wherein a surface resin layer formed of the resin composition is provided on the surface of said wafer-holding ring at least in its portion which can come into contact with a wafer and has a thickness of not less than 50 $\mu$m.

5. The wafer-holding ring for a chemical mechanical polishing apparatus according to claim 2, wherein a surface resin layer formed of the resin composition is provided on the surface of said wafer-holding ring at least in its portion which can come into contact with a wafer and has a thickness of not less than 50 $\mu$m.

6. The wafer-holding ring for a chemical mechanical polishing apparatus according to claim 1, wherein a surface resin layer formed of the resin composition is provided on the surface of said wafer-holding ring at least in its portion which can come into contact with a wafer and has a thickness of not less than 50 $\mu$m.

7. The wafer-holding ring for a chemical mechanical polishing apparatus according to claim 1, wherein the whole wafer-holding ring is formed of the resin composition.

8. A wafer-holding ring for a chemical mechanical polishing apparatus, adapted for holding a wafer on the chemical mechanical polishing apparatus, wherein the surface of said wafer-holding ring at least in its portion, which can come into contact with a wafer, is formed of a resin composition comprising not less than 30% by weight of polybenzimidazole, not more than 70% by weight of polyarylene ketone and not more than 40% by weight of a filler.

9. A wafer-holding ring for a chemical mechanical polishing apparatus, adapted for holding a wafer on the chemical mechanical polishing apparatus, wherein the surface of said wafer-holding ring at least in its portion, which can come into contact with a wafer, is formed of a resin composition comprising not less than 30% by weight of polybenzimidazole and not more than 70% by weight of polyarylene ketone, wherein a surface resin layer formed of the resin composition is provided on the surface of said wafer-holding ring at least in its portion which can come into contact with a wafer and has a thickness of not less than 50 $\mu$m.

* * * * *